United States Patent [19]

Iwamura et al.

[11] Patent Number: 4,886,641

[45] Date of Patent: Dec. 12, 1989

[54] ELECTRICAL CONTACT SPRING MATERIAL MADE OF COPPER BASE ALLOY OF HIGH STRENGTH AND TOUGHNESS WITH REDUCED ANISOTROPY IN CHARACTERISTICS

[75] Inventors: Takuro Iwamura; Masao Kobayashi, both of Ohmiya, Japan

[73] Assignee: Mitsubishi Kinzoku Kabushiki Kaisha, Tokyo, Japan

[21] Appl. No.: 183,778

[22] Filed: Apr. 20, 1988

[30] Foreign Application Priority Data

Apr. 28, 1987 [JP] Japan ..... 62-105924
Dec. 17, 1987 [JP] Japan ..... 62-319933

[51] Int. Cl.[4] ..... C22C 9/00

[52] U.S. Cl. ..... 420/470; 420/477; 420/481; 420/484; 420/487; 420/488; 420/490; 420/492; 439/887

[58] Field of Search ..... 420/469, 470, 477, 481, 420/484, 487, 488, 489, 490, 492, 495, 496; 439/887

[56] References Cited

U.S. PATENT DOCUMENTS 4,749,548 6/1988 Akutsu et al. ..... 420/469

FOREIGN PATENT DOCUMENTS 370883 10/1930 United Kingdom ..... 420/492

*Primary Examiner*—L. Dewayne Rutledge
*Assistant Examiner*—George Wyszomierski
*Attorney, Agent, or Firm*—Frishauf, Holtz, Goodman & Woodward

[57] ABSTRACT

A novel electrical contact spring material made of a copper base alloy is disclosed. This spring material has high strength and toughness, as well as good adhesion of solder. It also has reduced anisotropy in its characteristics in two directions, i.e., the working direction and the direction perpendicular to it. A very thin-walled member can be produced from this spring material since its anisotropy in characteristics is small and will not increase even if the amount of working is increased.

The copper base alloy of which this spring material is made consists essentially of 2.2–5% Ti, 0.1–0.8% Co, 0.02–0.5% Cr, 0–0.6% of Ni and/or Fe, 0–0.5% of at least one of Ca, Mg, Zn, Cd, Li, Zr, Si, Mn, Sn and Al, and the balance being Cu and incidental impurities.

11 Claims, 1 Drawing Sheet

ELECTRICAL CONTACT SPRING MATERIAL MADE OF COPPER BASE ALLOY OF HIGH STRENGTH AND TOUGHNESS WITH REDUCED ANISOTROPY IN CHARACTERISTICS

BACKGROUND OF THE INVENTION

The present invention relates to a copper base spring material for use in electrical contacts that has high strength and toughness, as well as good adhesion of solder and which has reduced anisotropy in characteristics in that its characteristics do not differ greatly in two directions, i.e., the working direction and the direction perpendicular to it.

Copper base alloys containing 2–5 percent by weight of Ti (all percents noted hereinafter are on a weight basis) are precipitation hardening type copper alloys that have strength comparable to beryllium copper and have conventionally been used as contact materials, or spring materials for use in electrical contact members such as connectors and switches that require high strength and toughness.

Typical conventional electrical contact arrangements are shown in FIGS. 1–4.

The demand for smaller and lighter device parts has increased constantly these days and to meet this need, a tendency toward decreasing the wall thickness of parts while increasing their strength is inevitable. If the amount of working increases as in the case of rolled or drawn materials, their mechanical characteristics will become greatly different in two directions, i.e., the working direction and the direction perpendicular to it. The anisotropy in characteristics is fatal to spring materials, particularly, to the threshold value of springs or resistance to cyclic bending. If inhomogeneity in materials characteristics occurs in electrical contacts that need to be bent in complex shapes for their fabrication, torsion will occur after working or their dimensional precision is impaired to such an extent that the intended bending becomes practically impossible.

The anisotropy in characteristics is particularly noticeable in the prior art Cu-Ti alloy described above and several disadvantages will occur. First, the alloys cannot be worked by the necessary great amount. Secondly, the working process requires an extra step of heat treatment under sufficiently elevated temperatures to eliminate the anisotropy. However, not only does this lead to a complex and costly working process but also the high temperatures employed will inevitably cause grain growth, embrittlement and oxidation.

SUMMARY OF THE INVENTION

An object, therefore, of the present invention is to provide an improved Co-Ti alloy that has reduced anisotropy in its characteristics and good adhesion of solder and which hence is suitable for use as a spring material for electrical contacts.

As a result of extensive studies conducted in order to attain the above-stated object, the present inventors have obtained the following observations: if both Co and Cr are incorporated as alloying elements in the prior art Cu-Ti alloy, it can be worked with a dramatic decrease in anisotropy in its characteristics; at the same time, the primary crystals in the Co-Ti intermetallic compound are effectively refined by the action of the Cr component to realize significant improvements in bending and plating properties, if Ni and/or Fe is additionally incorporated, an even greater reduction in anisotropy is accomplished; and an even better adhesion of solder can be attained by additionally incorporating at least one element selected from the group consisting of Ca, Mg, Zn, Cd, Li, Zr, Si, Mn, Sn and Al.

The present invention has been accomplished on the basis of these findings, and it provides a copper base spring material of high strength and toughness for use in an electrical contact that has reduced anisotropy in characteristics and good adhesion of solder and which consists essentially of 2.2–5% Ti, 0.1–0.8% Co, 0.02–0.5% Cr, 0–0.6% of Ni and/or Fe, 0–0.5% of at least one of Ca, Mg, Zn, Cd, Li, Zr, Si, Mn, Sn and Al, and the balance being Cu and incidental impurities.

BRIEF DESCRIPTION OF THE DRAWINGS

FIGS. 1–4 are sketches of typical electrical contact arrangements, in which FIG. 1 shows a leaf type contact, FIG. 2 is a pin-socket type contact, FIG. 3 is a blade-fork contact, and FIG. 4 is a wire type contact.

DETAILED DESCRIPTION OF THE INVENTION

Figure 1:
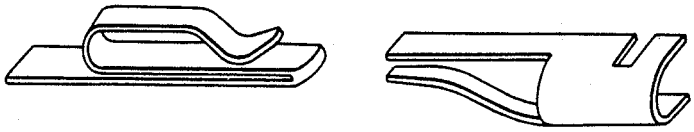
Fig. 1 (PRIOR ART)
Figure 2:
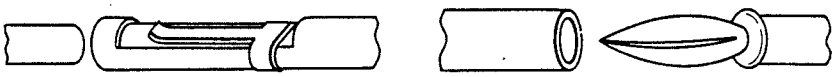
Fig. 2 (PRIOR ART)
Figure 3:
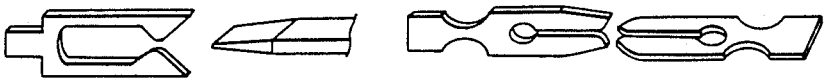
Fig. 3 (PRIOR ART)
Figure 4:
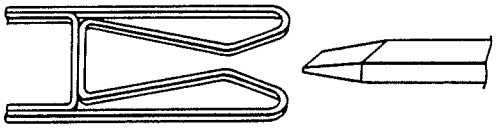
Fig. 4 (PRIOR ART)

The criticality of the composition of the Cu base alloy of the present invention is described hereinafter.

(a) Ti

The titanium component has the ability to improve the strength and toughness of the alloy. If the Ti content is less than 2.2%, these effects are not attained. If the Ti content exceeds 5%, the hot workability of the alloy is impaired. Therefore, the Ti content is limited to be within the range of 2.2–5%.

(b) Co and Cr

As already mentioned, Co and Cr, when present in combination, are capable of not only allowing the alloy to be worked without introducing great anisotropy in its characteristics but also refining the metallurgical structure of the alloy to improve its bending and plating properties. If the Co and Cr contents are less than 0.1% and 0.02%, respectively, these effects are not attained. If the Co and Cr contents exceed 0.8% and 0.5%, respectively, coarse crystal grains will become dispersed in the matrix to impair the alloy's bending and plating properties. Therefore, the contents of the respective components are limited to be within the ranges of 0.1–0.8% (preferably 0.2–0.5%) for Co and 0.02–0.5% (preferably 0.05–0.2%) for Cr.

(c) Ni and Fe

These elements are effective for the purpose of further reducing the anisotropy of the alloy in its characteristics. They also have the ability to provide increased electrical conductivity. Being optional components, these elements should not be incorporated in an amount exceeding 0.6% for each or the combination thereof. Otherwise, the strength of the alloy will be described and grain growth occurs in the crystallized intermetallic compound. Therefore, the content of Ni and/or Fe, if they are added at all, should not exceed 0.6%, with the range of 0.05–0.6% being preferred.

(d) Ca, Mg, Zn, Cd, Li, Zr, Si, Mn, Sn and Al

These optical components are effective in providing improved adhesion of solder. If one or more of these elements are incorporated in a total amount exceeding 0.5%, the alloy's ability to adhere to solder will be significantly deteriorated. Therefore, these elements, if used at all, should not be added above 0.5%. The preferred range is from 0.01 to 0.5%.

The following example is provided for the purpose of further illustrating the present invention but is in no way to be taken as limiting.

EXAMPLE

Melts having the composition noted in Table 1 were prepared in a graphite crucible in a common high-frequency vacuum melting furnace. The melts were mold-cast into cylindrical ingots each having a diameter of 60 mm and a weight of 5 kg. After scalping, the ingots were forged and rolled under hot conditions into plates measuring 100 mm wide and 6 mm thick. The plates were then subjected to a solid solution treatment consisting of holding at 920° C. for 1 hour and quenching in water. The plates were further subjected to cyclic treatments consisting of cold rolling and intermediate annealing at temperatures between 360° and 500° C., followed by final cold rolling to 50% reduction in thickness. By finally performing stress relieving annealing at 360° C. for 20 minutes, thin plates 0.25 μm thick were produced from Cu base alloy sample Nos. 1–24 within the scope of the present invention and from comparative sample Nos. 1–3.

The tensile strength, elongation and threshold value of spring of each plate sample were measured both in the rolling direction and in the direction perpendicular to it. A cyclic bending test was also conducted by the following method: a test piece was held upright between two supports on a jig each having a curved edge with a radius of 0.2 mm; the test piece was cyclically bent about the supports by 90° in opposite directions four 90° bends from one side to the other until cracking occurred in the bent portion. The resistance of the sample to cyclic bending was evaluated by counting the number of bendings the same could withstand without cracking (i.e., how many times the sample could be bent through 90°).

The adhesion of solder to the samples was evaluated by the following method: each test piece was dipped in molten solder (Sn-37% Pb) at 230° C. to deposit a solder coat ca. 10 μm on the surface of the test piece; the soldered piece was heated in a furnace at 150° C. in the atmospheric air; every 100 hours, the piece was taken out of the heating furnace and a cross section was observed under an optical microscope to check for the occurrence of separation between the solder coat and the substrate. The total period of time until separation occurred was used as an index of solder adhesion. The heating period did not exceed 1,000 hours.

The results of all tests and measurements conducted are summarized in Table 2.

TABLE 1

| | Sample No. | Ti | Co | Cr | Ni | Fe | Solder adhesion improving components | | Cu + impurities |
|---|---|---|---|---|---|---|---|---|---|
| | 1 | 2.31 | 0.40 | 0.11 | — | — | — | | bal. |
| | 2 | 3.20 | 0.41 | 0.10 | — | — | — | | " |
| | 3 | 4.54 | 0.41 | 0.11 | — | — | — | | " |
| | 4 | 4.01 | 0.15 | 0.10 | — | — | — | | " |
| | 5 | 4.02 | 0.71 | 0.11 | — | — | — | | " |
| | 6 | 4.13 | 0.31 | 0.041 | — | — | — | | " |
| | 7 | 4.01 | 0.29 | 0.41 | — | — | — | | " |
| | 8 | 3.90 | 0.20 | 0.11 | — | 0.21 | — | | " |
| Cu | 9 | 3.92 | 0.21 | 0.10 | 0.056 | — | — | | " |
| alloy | 10 | 3.92 | 0.21 | 0.10 | 0.30 | 0.23 | — | | " |
| of the | 11 | 3.61 | 0.40 | 0.11 | — | — | Ca | 0.21 | " |
| present | 12 | 3.99 | 0.40 | 0.09 | — | — | Mg | 0.06 | " |
| inven- | 13 | 4.04 | 0.41 | 0.11 | — | — | Zn | 0.46 | " |
| tion | 14 | 3.94 | 0.42 | 0.10 | — | — | Cd | 0.011 | " |
| | 15 | 3.94 | 0.23 | 0.10 | — | 0.33 | Ca | 0.013 | " |
| | 16 | 3.96 | 0.23 | 0.10 | 0.21 | — | Ca | 0.013 | " |
| | | | | | | | Zn | 0.21 | |
| | | | | | | | Ca | 0.03 | |
| | 17 | 4.02 | 0.54 | 0.10 | 0.34 | — | Mg | 0.04 | " |
| | | | | | | | Cd | 0.21 | |
| | | | | | | | Mg | 0.21 | |
| | 18 | 3.98 | 0.31 | 0.10 | 0.11 | 0.11 | Ca | 0.15 | " |
| | | | | | | | Cd | 0.21 | |
| | 19 | 4.01 | 0.41 | 0.10 | — | — | Li | 0.05 | " |
| | 20 | 4.12 | 0.42 | 0.11 | — | — | Zr | 0.06 | bal. |
| | 21 | 4.05 | 0.39 | 0.10 | — | — | Si | 0.03 | " |
| | 22 | 4.03 | 0.40 | 0.10 | — | — | Mn | 0.05 | " |
| | 23 | 4.07 | 0.41 | 0.09 | — | — | Sn | 0.05 | " |
| | 24 | 3.98 | 0.40 | 0.11 | — | — | Al | 0.05 | " |
| Compara- | 1 | 4.01 | —* | —* | — | — | — | | " |
| tive Cu | 2 | 4.02 | 0.40 | —* | — | — | — | | " |
| alloy | 3 | 4.03 | —* | 0.13 | — | — | — | | " |

TABLE 2

| Sample No. | Tensile strength (kg/mm²) Working direction | Tensile strength (kg/mm²) Transverse direction | Elongation (%) Working direction | Elongation (%) Transverse direction | Threshold value of spring (kg/mm²) Working direction | Threshold value of spring (kg/mm²) Transverse direction | Number of cyclic bends Working direction | Number of cyclic bends Transverse direction | Time to solder separation (hrs.) |
|---|---|---|---|---|---|---|---|---|---|
| 1 | 89 | 90 | 20 | 24 | 74 | 82 | 28 | 20 | 500 |
| 2 | 104 | 104 | 12 | 15 | 85 | 92 | 26 | 17 | 500 |

TABLE 2-continued

| Sample No. | | Tensile strength (kg/mm²) Working direction | Tensile strength (kg/mm²) Transverse direction | Elongation (%) Working direction | Elongation (%) Transverse direction | Threshold value of spring (kg/mm²) Working direction | Threshold value of spring (kg/mm²) Transverse direction | Number of cyclic bends Working direction | Number of cyclic bends Transverse direction | Time to solder separation (hrs.) |
|---|---|---|---|---|---|---|---|---|---|---|
| | 3 | 118 | 120 | 8 | 10 | 98 | 110 | 20 | 13 | 500 |
| Cu alloy | 4 | 113 | 114 | 8 | 11 | 90 | 99 | 22 | 12 | 500 |
| of the | 5 | 115 | 116 | 7 | 9 | 91 | 103 | 19 | 9 | 500 |
| present | 6 | 113 | 114 | 8 | 11 | 89 | 98 | 22 | 14 | 500 |
| inven- | 7 | 116 | 118 | 8 | 10 | 93 | 104 | 20 | 9 | 500 |
| tion | 8 | 115 | 117 | 10 | 12 | 92 | 104 | 23 | 14 | 600 |
| | 9 | 114 | 116 | 10 | 12 | 91 | 101 | 23 | 14 | 600 |
| | 10 | 117 | 119 | 8 | 10 | 95 | 105 | 20 | 10 | 600 |
| | 11 | 105 | 105 | 12 | 16 | 86 | 91 | 26 | 18 | no separation |
| | 12 | 104 | 105 | 13 | 16 | 88 | 92 | 25 | 17 | " |
| | 13 | 104 | 105 | 11 | 16 | 86 | 92 | 25 | 19 | " |
| | 14 | 103 | 104 | 12 | 15 | 98 | 91 | 25 | 20 | " |
| | 15 | 105 | 106 | 11 | 15 | 88 | 91 | 25 | 17 | " |
| | 16 | 102 | 103 | 12 | 15 | 88 | 90 | 24 | 20 | " |
| | 17 | 114 | 117 | 8 | 12 | 93 | 102 | 20 | 12 | " |
| | 18 | 106 | 106 | 12 | 16 | 87 | 92 | 24 | 18 | " |
| | 19 | 104 | 105 | 13 | 16 | 88 | 92 | 25 | 17 | " |
| | 20 | 103 | 104 | 14 | 16 | 89 | 93 | 24 | 18 | no separation |
| | 21 | 104 | 104 | 14 | 15 | 90 | 93 | 25 | 18 | " |
| | 22 | 105 | 106 | 13 | 15 | 89 | 92 | 26 | 19 | " |
| | 23 | 104 | 105 | 13 | 14 | 89 | 91 | 25 | 18 | " |
| | 24 | 103 | 104 | 13 | 16 | 90 | 92 | 24 | 18 | " |
| Compara- | 1 | 105 | 108 | 7 | 13 | 68 | 90 | 20 | 5 | 100 |
| tive | 2 | 108 | 111 | 8 | 13 | 80 | 98 | 21 | 7 | 200 |
| Cu alloy | 3 | 107 | 110 | 7 | 13 | 75 | 94 | 20 | 6 | 200 |

The data in Table 2 shows that Cu alloy sample Nos. 1–24 within the scope of the present invention had high strength and toughness, with minimum anisotropy in these properties, and that they exhibited good adhesion of solder. On the other hand, comparative sample Nos. 1–3 which were outside the scope of the present invention in terms of the content of one or more components (as indicated by an asterisk in Table 1) were inferior to the samples of the present invention in at least one of the characteristics described above.

As described on the foregoing pages, the copper base alloy of the present invention has high strength and toughness, with minimum anisotropy in these properties. Since this very small anisotropy will not increase even if the alloy is subjected to a greater amount of working, a very thin plate can be produced from the alloy, this alloy has the additional advantage of good adhesion of solder. For these advantages, the alloy of the present invention is useful as lighter and smaller spring material in electrical contact members such as connectors and switches. In addition, the spring material made of this alloy will exhibit its intended performance over a prolonged period.

What is claimed is:

1. An electrical contact spring material made of a copper base alloy having high strength and toughness and reduced anisotropy, said alloy consisting essentially of 2.2–5% Ti, 0.1–0.8% Co, 0.02–0.5% Cr, a total of from 0 to 0.6% of at least one element selected from the group consisting of Ni and Fe, and a total of from 0 to 0.5% of at least one solder adhesion improving component selected from the group consisting of Ca, Mg, Zn, Cd, Li, Zr, Si, Mn, Sn and Al, and the balance being Cu and incidental impurities, all percents being on a weight basis.

2. The electrical contact spring material according to claim 1 wherein the Co content is 0.2–0.5% and the Cr content is 0.05–0.2%.

3. The electrical contact spring material according to claim 2 which contains at least one of Ni and Fe in a total amount of 0.05–0.6%.

4. The electrical contact spring material according to claim 1 which contains at least one of Ni and Fe in a total amount of 0.05–0.6%.

5. The electrical contact spring material according to any one of claims 1 to 3 wherein the solder adhesion improving component is present in an amount of 0.01–0.5%.

6. The electrical contact spring material according to claim 5 wherein said solder adhesion improving component is at least one element selected from the group consisting of Ca Mg, Zn and Cd.

7. The electrical contact spring material according to claim 5 wherein said solder adhesion improving component is at least one element selected from the group consisting of Li, Zr, Si, Mn, Sn and Al.

8. The electrical contact spring material according to any one of claims 1 to 3 wherein said solder adhesion improving component is at least one element selected from the group consisting of Ca, Mg, Zn and Cd.

9. The electrical contact spring material according to any one of claims 1 to 3 wherein said solder adhesion improving component is at least one element selected from the group consisting of Li, Zr, Si, Mn, Sn and Al.

10. An electrical contact spring element having at least one surface for making electrical contact comprising the electrical contact spring material of claim 1.

11. An electrical spring contact arrangement comprising:

at least a first contact member;

at least a second contact member which is engageable with said first contact member to make an electrical connection therebetween;

at least one of said first and second contact members comprising spring means for springingly engaging the other of said contact members; and said at least one of said first and second contact members comprising the material of claim 1.

* * * * *